US011874018B1

(12) United States Patent
Bonner et al.

(10) Patent No.: US 11,874,018 B1
(45) Date of Patent: Jan. 16, 2024

(54) COOLING AND DEHUMIDIFCATION SYSTEM

(71) Applicant: Transaera, Inc., Somerville, MA (US)

(72) Inventors: Ross Bonner, Salem, MA (US); Matthew H. Dorson, Somerville, MA (US)

(73) Assignee: Transaera, Inc., Somerville, MA (US)

( * ) Notice: Subject to any disclaimer, the term of this patent is extended or adjusted under 35 U.S.C. 154(b) by 6 days.

(21) Appl. No.: 17/519,473

(22) Filed: Nov. 4, 2021

Related U.S. Application Data

(60) Provisional application No. 63/109,840, filed on Nov. 4, 2020.

(51) Int. Cl.
*F24F 3/14* (2006.01)
*F28F 13/18* (2006.01)

(52) U.S. Cl.
CPC ..... *F24F 3/1411* (2013.01); *F24F 3/1423* (2013.01); *F28F 13/187* (2013.01); *F24F 2003/144* (2013.01); *F24F 2203/021* (2013.01); *F28F 2245/02* (2013.01)

(58) Field of Classification Search
CPC .. F24F 3/1411; F24F 3/1429; F24F 2003/144; F24F 2003/1446; F25B 39/00; F25B 39/02; F28F 13/18–187
See application file for complete search history.

(56) References Cited

U.S. PATENT DOCUMENTS 3,448,561 A 6/1969 Seibert et al.
4,182,412 A * 1/1980 Shum ..... F28F 13/187 165/905
4,527,398 A 7/1985 Schaetzle
4,552,570 A 11/1985 Gravatt
4,664,182 A * 5/1987 Miwa ..... F28F 13/18 62/272
5,298,231 A 3/1994 Rockenfeller
6,226,888 B1 5/2001 Lang
6,311,511 B1 11/2001 Maeda
6,318,106 B1 11/2001 Maeda
6,904,962 B2 * 6/2005 Reinders ..... F24F 5/0035 165/166
6,951,242 B1 * 10/2005 Des Champs ..... F24F 8/158 165/146
7,730,736 B2 6/2010 Matsui et al.
7,841,194 B2 11/2010 Ishida et al.
(Continued)

FOREIGN PATENT DOCUMENTS

CN 102506475 A 6/2012
CN 214305404 U 9/2021
(Continued)

OTHER PUBLICATIONS

Rieth et al., Tunable Metal-Organic Frameworks Enable High-Efficiency Cascaded Adsorption Heat Pumps. JACS. Nov. 21, 2018;140(50):17591-6. Supporting Information.
(Continued)

*Primary Examiner* — Christopher R Zerphey

(57) ABSTRACT

A cooling and dehumidification system, including a rotary desiccant assembly at least partially coated with a desiccant material, the desiccant material configured to rotate, thereby providing for simultaneous loading and unloading of moisture.

8 Claims, 15 Drawing Sheets

Side View

(56) References Cited

U.S. PATENT DOCUMENTS

| | | | | |
|---|---|---|---|---|
| 7,997,098 | B2 * | 8/2011 | Yabu | F28F 13/187 62/271 |
| 9,074,522 | B2 | 7/2015 | Scholt et al. | |
| 9,146,040 | B2 | 9/2015 | DeValve | |
| 9,255,744 | B2 * | 2/2016 | Huizing | F28D 19/00 |
| 9,475,476 | B1 | 10/2016 | Wright | |
| 9,855,595 | B2 | 1/2018 | Michel et al. | |
| 10,254,049 | B2 * | 4/2019 | Mittelbach | F28D 7/082 |
| 10,589,220 | B1 | 3/2020 | DiMaiolo et al. | |
| 11,255,616 | B2 * | 2/2022 | Brockway | B05D 7/52 |
| 11,619,437 | B2 * | 4/2023 | Bostic, Jr. | H05B 3/145 62/276 |
| 2007/0193287 | A1 | 8/2007 | Ishida et al. | |
| 2012/0031273 | A1 | 2/2012 | Heer | |
| 2013/0239814 | A1 | 9/2013 | Ito et al. | |
| 2015/0153051 | A1 | 6/2015 | Pahwa et al. | |
| 2017/0321909 | A1 | 11/2017 | Davies | |
| 2019/0178574 | A1 | 6/2019 | Naito | |
| 2019/0203958 | A1 | 7/2019 | Wang et al. | |
| 2020/0232665 | A1 | 7/2020 | Hirai et al. | |
| 2020/0355383 | A1 | 11/2020 | Stahelin et al. | |
| 2023/0022397 | A1 | 1/2023 | Maeda et al. | |

FOREIGN PATENT DOCUMENTS

| | | | |
|---|---|---|---|
| CN | 217898889 | U | 11/2022 |
| EP | 1 804 005 | A1 | 7/2007 |
| EP | 3 054 224 | A1 | 8/2016 |
| JP | 2013-190177 | A | 9/2013 |
| WO | WO 2009/057323 | A1 | 5/2009 |
| WO | WO 2019/089971 | A1 | 5/2019 |
| WO | WO 2021/200072 | A1 | 10/2021 |

OTHER PUBLICATIONS

Zu et al., Performance comparison between metal-organic framework (MOFs) and conventional desiccants (silica gel, zeolite) for a novel high temperature cooling system. IOP Conf Series Mater Sci Eng. 2019;609(5):052013.

Cui et al., Metal-Organic Frameworks as advanced moisture sorbents for energy-efficient high temperature cooling. Sci Rep. Oct. 16, 2018;8(1):15284. doi: 10.1038/s41598-018-33704-4.

Jeremias et al., Advancement of sorption-based heat transformation by a metal coating of highly-stable, hydrophilic aluminium fumarate MOF. RSC Adv. May 13, 2014;4(46):24073-82.

Metrane et al., Water Vapor Adsorption by Porous Materials: From Chemistry to Practical Applications. J Chem Eng Data. Jun. 27, 2022;67(7):1617-53.

Tu et al., Comfortable, high-efficiency heat pump with desiccant-coated, water-sorbing heat exchangers. Sci Rep. Jan. 12, 2017;7:40437. doi: 10.1038/srep40437.

Overbey, Defining humidity ratio and relative humidity. Building Enclosure. Apr. 4, 2018: 5 pages.

* cited by examiner

Regeneration Mode

Side View

Regeneration Cycle

Process Cycle

First Half-Cycle

COOLING AND DEHUMIDIFCATION SYSTEM

RELATED APPLICATIONS

This application claims the benefit of U.S. Provisional Application Ser. No. 63/109,840, filed Nov. 4, 2020, entitled COOLING AND DEHUMIDIFCATION SYSTEM, the entire disclosure of which is herein incorporated by reference.

FIELD OF THE INVENTION

The present application relates to cooling and dehumidification systems using a rotary desiccant assembly.

BACKGROUND OF THE INVENTION

The rising demand for cooling is putting an enormous strain on the environment, grid infrastructure, and the global climate. Meeting the world's demand for cooling while minimizing its negative impacts will be one of the defining challenges of our time. This challenge can be addressed by redesigning today's air conditioning systems to take advantage of new materials and chemical processes.

SUMMARY OF THE INVENTION

One aspect of the disclosure provides is a cooling and dehumidification system, comprising: a rotary desiccant assembly comprising a desiccant wheel that is at least partially coated with a desiccant material, the desiccant wheel configured to rotate, thereby providing for simultaneous loading and unloading of moisture on the desiccant material.

In one example, the desiccant material is configured to be unloaded with a low grade waste heat from an air conditioning system.

In one example, the desiccant material comprises at least one of a metal-organic framework (MOF) compound, a silica gel, zeolite, or temperature-responsive hygroscopic polymer.

In one example, the desiccant material is completely coated with desiccant material.

Another aspect provides a wheel structure using desiccant material that can be unloaded with low grade waste heat such that moisture is desorbed from the desiccant material, wherein the low grade waste heat is from an air conditioning system.

Another aspect of the disclosure is an interrupted desiccant drum configured to allow removal of moisture in an air conditioning system.

Another aspect of the disclosure is a cascade cycle adsorption cooling and dehumidification system, comprising of at least two closed loop adsorption loops arranged so that heat of adsorption from a first loop drives the second loop cycle. This system is followed by an open loop drying cycle to remove moisture from the room air.

Another aspect of the disclosure is an indoor cooling unit comprising a desiccant coated heat exchanger and a separate water condensing coil arranged to cycle between a mode of loading and cooling and a mode and unloading and water condensing.

Another aspect of the disclosure is a heat exchanger, partially coated with a desiccant material, such that heat and moisture exchange occur sequentially as air passes though the device. This allows the heat of adsorption and desorption to be transferred to and from a thermal fluid.

Another aspect of the disclosure is a cascade cycle adsorption cooling and dehumidification system, comprising: at least two closed loop adsorption loops arranged so that heat from a first closed loop drives a second closed loop.

Another aspect of the disclosure is a heat exchanger, at least partially coated with a desiccant material, such that heat and moisture exchange occur sequentially as air passes though the heat exchanger.

In one example, the heat of adsorption and desorption are transferred to and from a thermal fluid, in particular heat of adsorption is transferred to the thermal fluid and heat of desorption is transferred from the thermal fluid.

Another aspect of the disclosure provides a cooling and dehumidification system, comprising: a coated desiccant wheel defining a process section configured to adsorb moisture and a regeneration section configured to desorb moisture simultaneously with the adsorption of the process section; and a direct expansion vapor compression assembly, comprising: an evaporator configured to cool a stream of hot and dry air from the process section of the coated desiccant wheel; a condenser configured to heat a stream of ambient air; and a valve configured to direct the heated stream of ambient air to the regeneration section of the coated desiccant wheel.

In one example, the coated desiccant wheel is coated with at least one of: a metal organic framework (MOF); silica gel zeolite; or temperature-responsive hygroscopic polymer.

In one example, the system has direct or indirect air supply from both a conditioned space and an ambient environment.

In one example, the direct expansion vapor compression assembly further comprises an auxiliary heater or supplementary regeneration device.

In one example, the valve comprises a three-way valve.

In one example, the coated desiccant wheel includes a substrate comprising a plastic or open cell foam structure.

In one example, the coated desiccant wheel is configured to rotate to provide continuous transfer of moisture from a process stream to a regeneration stream and simultaneous loading and unloading of moisture.

In one example, the desiccant wheel rotates at a predetermined constant or adjustable angular velocity.

Another aspect of the disclosure provides a method, comprising: drawing room return air through a process section of a coated desiccant wheel; loading the coated desiccant wheel with the room return air, resulting in hot and dry air; cooling the hot and dry air with an evaporator, resulting in cool and dry air; returning the cool and dry air to a conditioned space.

In one example, drawing room return air is performed by a fan.

In one example, ambient air is heated with low grade waste heat from an air condition system.

In one example, the method further includes: heating ambient air using a condenser, resulting in hot air; splitting the hot air, using a valve, into a first stream of air and a second stream of air; passing the first stream of air to ambient; passing the second stream of air through a regeneration portion of the coated desiccant wheel, resulting in hot and moist air; and passing the hot and moist air to ambient.

In one example, the valve is a three-way valve.

Another aspect of the disclosure a heat exchanger assembly, comprising: at least one tube configured to carry refrigerant or thermal fluid; and a plurality of fins in thermal contact with the at least one tube, wherein each of the plurality of fins comprises a coated portion and an uncoated portion.

In one example, the coated portion comprises approximately 10%-90% of each respective fin.

In one example, the coated portion comprises at least one of: a metal organic framework (MOF); silica gel zeolite; or temperature-responsive hygroscopic polymer.

In one example, the assembly operates a process cycle in which: a) air flows across the uncoated portion of the plurality of fins and is sensibly cooled by transferring heat to the refrigerant or thermal fluid; and b) after a), the air flows across the coated portion of the plurality of fins.

In one example, the assembly operates a regeneration cycle in which: a) air flows across the uncoated portion of the plurality of fins and is sensibly heated by transferring heat from the refrigerant or thermal fluid; and b) after a), the air flows across the coated portion of the plurality of fins and continues to be sensibly heated by the refrigerant or thermal fluid.

BRIEF DESCRIPTION OF THE DRAWINGS

The invention description below refers to the accompanying drawings, of which.

DETAILED DESCRIPTION

Figure 1A:
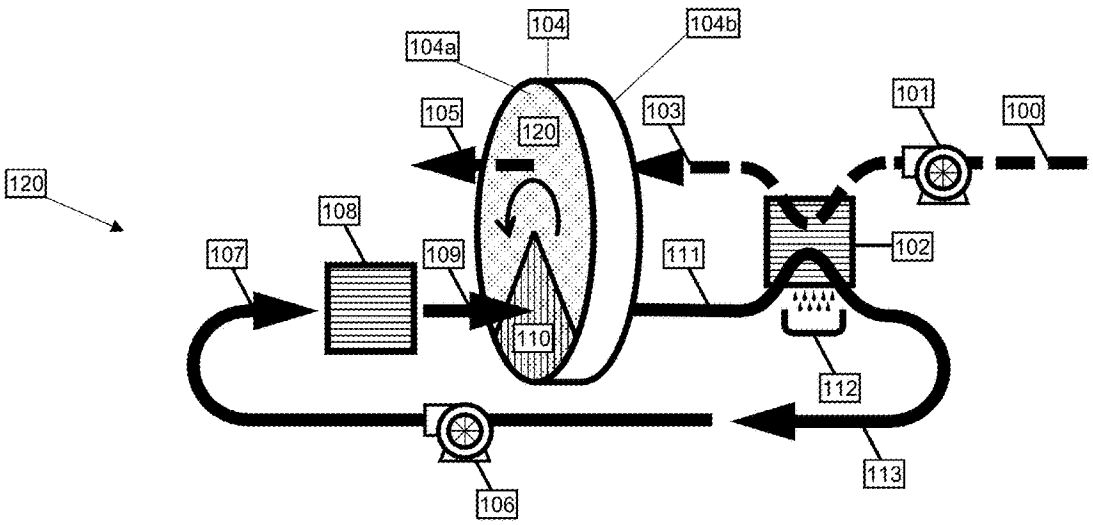
FIG. 1A depicts a water harvesting system using a MOF coated desiccant wheel.
Figure 1B:
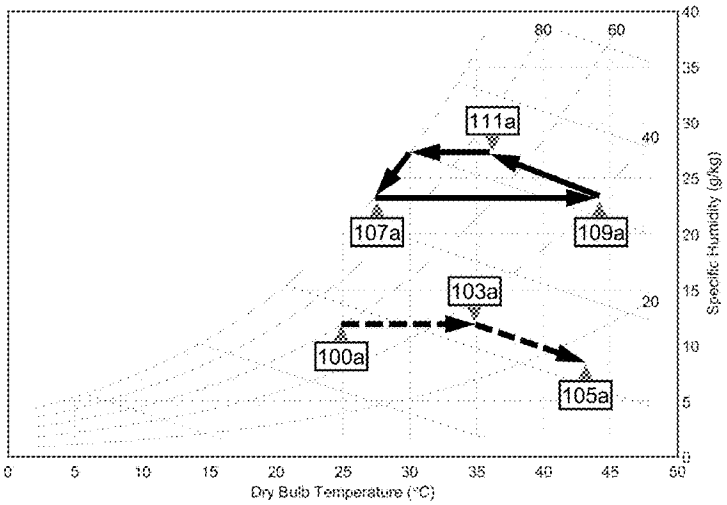
FIG. 1B depicts a psychrometric chart depicting specific humidity (y-axis) vs. dry bulb temperature (x-axis) of the air at various points in the water harvesting system of FIG. 1A.

FIG. 1A depicts a water harvesting system (120) using a MOF coated desiccant wheel (104) and FIG. 1B depicts a psychrometric chart depicting specific humidity (y-axis) vs. dry bulb temperature (x-axis) of the air at various points in the water harvesting system 120 of FIG. 1A.

As shown, the system (120) can include a fan (101), a heat exchanger (102), desiccant wheel (104), fan (106), electric heating coil (108), and a reservoir (112) below the heat exchanger (102).

The desiccant wheel (104) (also referred to in some examples as an enthalpy wheel or a rotary desiccant assembly or rotary desiccant device) can be a three-dimensional structure and in this example can be cylindrical or substantially cylindrical. In this regard, the desiccant wheel (104) can have a substantially planar face (104*a*), a substantially planar face (104*b*) that is parallel and opposed to the planar face (104*a*). The desiccant wheel (104) can include a substrate made of any type of material (such as a thin metal foil, such as aluminum, or a fiber-based substrate such as a paper, a plastic, or a ceramic) and can be coated in a desiccant material. The desiccant wheel coating can be any type of hygroscopic substance, such as any type of metal-organic framework (MOF) compounds. In other examples, the desiccant wheel can be coated with silica gel zeolite, or temperature-responsive hygroscopic polymer. The desiccant wheel can be completely or partially coated with desiccant material, as described below.

In other examples, the substrate that forms the desiccant wheel (104) can be a MOF, plastic or open cell foam, or other high surface area, low thermal mass structures. Such materials can be used as substrates in this system because the materials used regenerate at lower temperature than conventional desiccant materials.

The desiccant wheel (104) can be manufactured according to various techniques, and in one example the substrate can be 3D printed as a unitary body. In another example, the desiccant wheel (104) can be 3D printed in a plurality of pieces (e.g., a plurality of portions of the overall cylindrical shape such as a plurality of pie-shaped sections) that can be adhered or otherwise engaged with one another to form the overall cylindrical shape. Other manufacturing methods can include corrugated channels or expanded foil honeycomb.

Desiccant wheels described below can have a similar or same structure and function as the wheel described with respect to FIG. 1A. In other examples, the desiccant wheel can be substituted with a drum configuration, such as depicted and described below with respect to FIG. 7. In this regard, it is contemplated that the drum configuration of FIG. 7 can be implemented with respect to the other examples of the present application.

In the process airstream, room return air (100) (depicted as 100*a* in FIG. 1B) is blown across a heat exchanger (102) by fan (101). The heated air (103) (depicted as 103*a* in FIG. 1B) passes through the process section (120) of the desiccant wheel (104) causing moisture to be adsorbed onto the desiccant that coats the desiccant wheel (104). Hot and dry air (105) (depicted as 105*b* in FIG. 1B) can be returned to the conditioned space, such as a room in a home. In the regeneration airstream, moist air (107) (depicted as 107*a* in FIG. 1B) is heated by an electric heating coil (108). The hot air (109) (depicted as 109*a* in FIG. 1B) passes through the regeneration section (110) of the desiccant wheel. In the example of FIG. 1A, while the regeneration section (110) is indicated as a different pattern to visually depict the portions of the wheel (104) that coincide with the regeneration stream and the process stream, it should be understood that desiccant wheel (104) can be uniformly coated with desiccant material and thus appear uniform.

As the desiccant wheel (104) rotates, the portion of the wheel (104) that coincided with the process stream rotates to coincide with the regeneration stream. In this regard, the moisture adsorbed on the desiccant while coinciding with the process stream is released to the regeneration air (111) (depicted as 111*a* in FIG. 1B) by desorption. The air (111) then passes through heat exchanger (102) where it is cooled by return air (100) below its dew point. Condensate from the regeneration stream is collected in a reservoir below the heat exchanger (112). The air (113) is subsequently passed to fan (106) where the cycle can be repeated.

As described above, the desiccant wheel (104) can be rotated (e.g., by way of a motor or other rotational motion technique) to provide for a continuous transfer of moisture from process stream to regeneration stream and simultaneous operation of the process stream and regeneration stream, allowing for simultaneous loading and unloading of moisture with respect to the same desiccant wheel. In this regard, the desiccant wheel (104) can be rotated at a predetermined constant or approximately constant angular velocity to achieve the continuous transfer. In some examples, the rotational velocity can be adjusted or adjustable according to parameters of the system to achieve the desired moisture transfer.

Figure 2A:
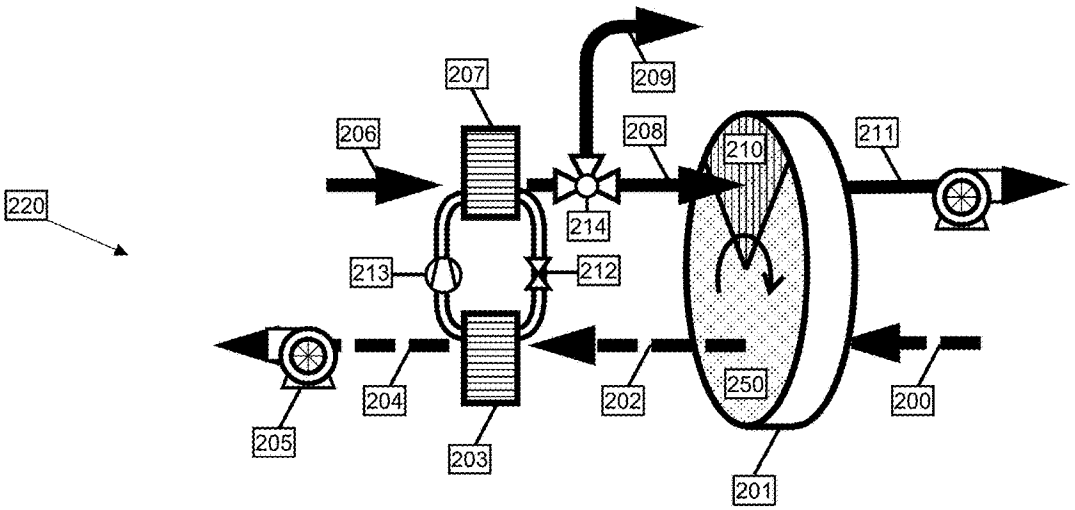
FIG. 2A depicts a cooling and dehumidification system using a MOF coated desiccant wheel in combination with a direct expansion vapor compression system.
Figure 2B:
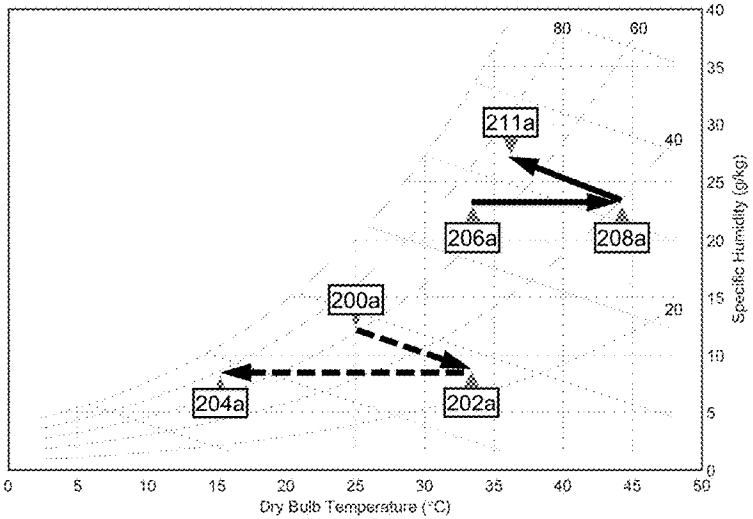
FIG. 2B depicts a psychrometric chart depicting specific humidity (y-axis) vs. dry bulb temperature (x-axis) of the air at various points in the cooling and dehumidification system of FIG. 2A.

FIG. 2A depicts a cooling and dehumidification system (220) using a coated desiccant wheel (201) in combination with a direct expansion vapor compression system. In this example, the wheel (201) can be coated with a MOF, while in other examples the wheel (201) can be coated with other substances, such as silica gel zeolite, or temperature-responsive hygroscopic polymer. FIG. 2B depicts a psychrometric chart depicting specific humidity (y-axis) vs. dry bulb temperature (x-axis) of various points in the cooling and dehumidification system of FIG. 2A.

In the process airstream, room return air (200) (depicted as 200*a* in FIG. 2B) is drawn through the process section (250) of the desiccant wheel (201) by a fan (205). Advantageously, the room return air (200) can be low grade waste heat, such as from an air condition system and in one particular example the waste heat can be from the compressor 213, allowing for the desiccant material to be unloaded with the low grade waste heat. The hot and dry air (202) (depicted as 202*a* in FIG. 2B) is then cooled by evaporator (203). The cool and dry air (204) (depicted as 204*a* in FIG. 2B) is returned to the conditioned space. In the regeneration stream, ambient air (206) (depicted as 206*a* in FIG. 2B) is heated by condenser (207). Hot air exiting the condenser is split by 3-way valve (214) to streams (209) which is rejected to ambient, and (208) (depicted as 208*a* in FIG. 2B) which passes through the regeneration portion (210 of the desiccant wheel. In another example, the hot air is split by a diverter. The hot and moist air (211) (depicted as 211*a* in FIG. 2B) exiting the desiccant wheel (201) is rejected to ambient. To ensure operation, system (220) requires direct (or indirect) air supply from both the conditioned space and the ambient environment. In some embodiments, an auxiliary heater or other supplementary regeneration device (such as an electric resistance heating coil, infrared heater, microwave heating, or ultrasonic device) can be optionally added at (208).

Figure 3A:
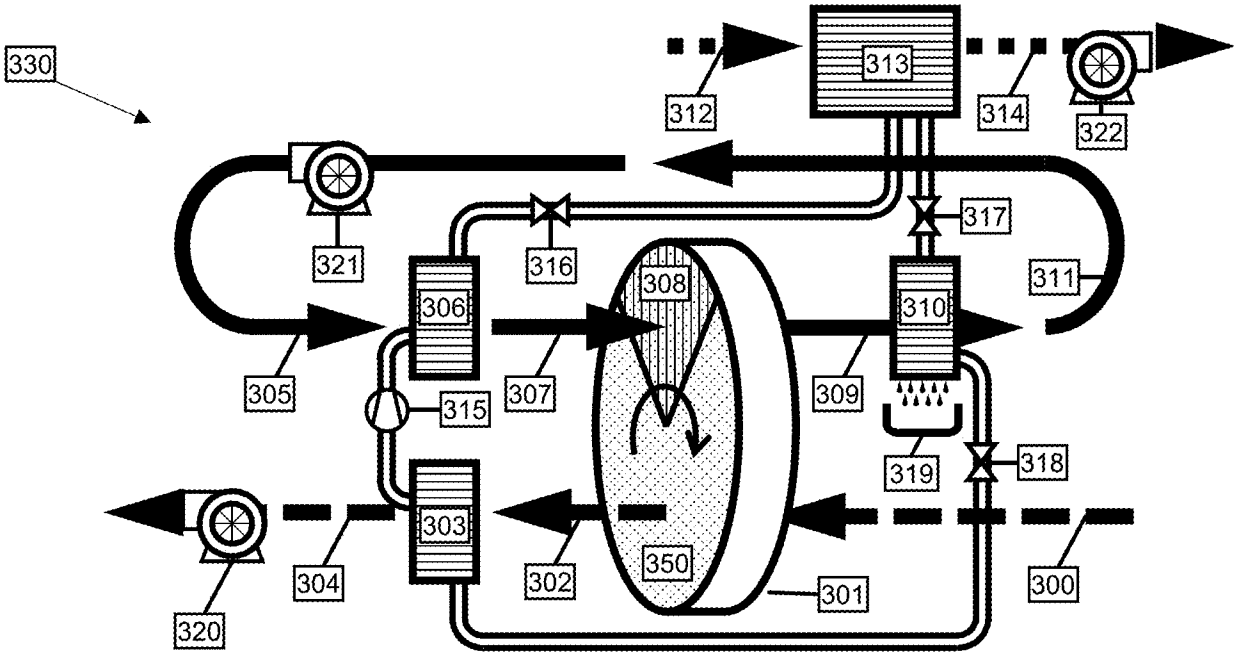
FIG. 3A depicts a cooling and dehumidification system using a MOF coated desiccant wheel in combination with a direct expansion vapor compression system.
Figure 3B:
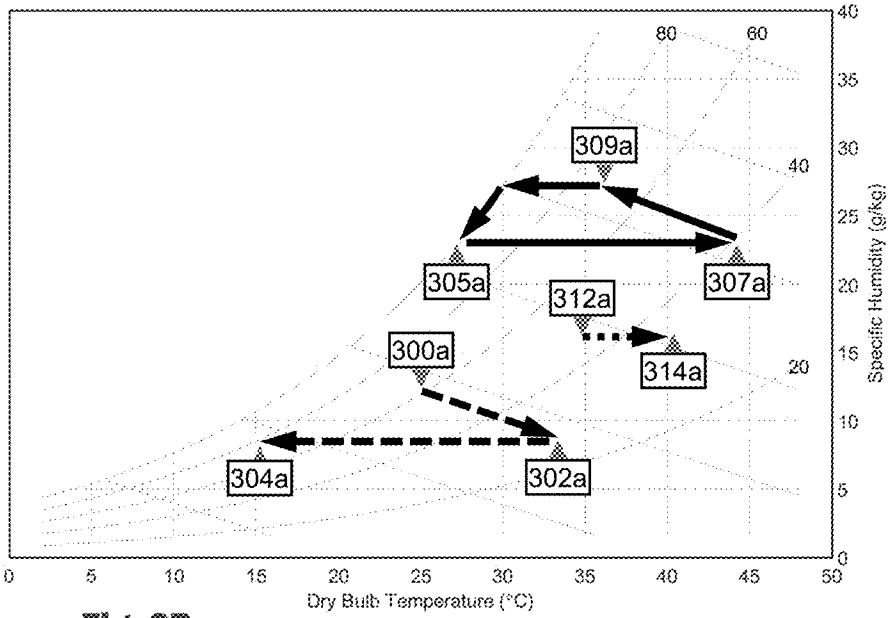
FIG. 3B depicts a psychrometric chart depicting specific humidity (y-axis) vs. dry bulb temperature (x-axis) of the air at various points in the cooling and dehumidification system of FIG. 3A.

FIG. 3A depicts a cooling and dehumidification system (330) using a desiccant wheel (301) in combination with a direct expansion vapor compression system. FIG. 3B depicts a psychrometric chart depicting specific humidity (y-axis) vs. dry bulb temperature (x-axis) of various points in the cooling and dehumidification system of FIG. 3A.

In the process airstream, room return air (300) (depicted as 300*a* in FIG. 3B) is drawn through the process section (350) of the desiccant wheel (301) by a fan (320). The hot and dry air (302) (depicted as 302*a* in FIG. 3B) is then cooled by evaporator (303). The cool and dry air (304) (depicted as 304*a* in FIG. 3B) is returned to the conditioned space. In the regeneration stream moist air (305) (depicted as 305*a* in FIG. 3B) is heated by a condensing coil (306), the hot air (307) (depicted as 307*a* in FIG. 3B) then passes through the regeneration portion (308) of the desiccant wheel (301). As the wheel rotates from process stream to regeneration stream (308), the moisture adsorbed on the desiccant is released to the regeneration air by desorption. The hot and moist air (309) (depicted as 309*a* in FIG. 3B) then passes through evaporator coil (310) where the air temperature is reduced below the dew point. Condensate forms on the coil (310) and is collected in a reservoir (319), e.g., drip pain, and removed from the indoor space by a gravity drain or pump. After moisture is removed by condensation, the air (311) is recirculated in a closed loop by a fan (321). Ambient air (312) (depicted as 312*a* in FIG. 3B) is drawn through condenser (313) as air (314) (depicted as 314*a* in FIG. 3B) by a fan (322).

In the refrigerant circuit, refrigerant is compressed by compressor (315) and passes through condenser coil (306) where some of the refrigerant condenses. The refrigerant then passes through throttling device (316) and condenser (313) where the remainder of the refrigerant condenses. The refrigerant then passes through throttling device (317) and evaporator (310) where some of the refrigerant evaporates. The refrigerant then passes through throttling device (318) and evaporator (303) where the remainder of the refrigerant evaporates, and returns to the suction side of compressor (315). The refrigerant can be, for example, R134a, R410a, R32, or R290. In other examples, the refrigerant can generally include hydrofluorocarbons (HFCs) or hydrocarbons (HCs).

In some embodiments, an auxiliary heater or other supplementary regeneration device is added at (307). In some embodiments, condensing coil (306) and condenser (313) are switched such that refrigerant first flows to (313), then to (306). In some embodiments, (303) and (310) are switched such that refrigerant first flows to (303), then to (310). In some embodiments, water from a municipal source, rainwater collection, or storage tank is used to cool the condenser (313) by spraying or dripping water over the coils.

Figure 4A:
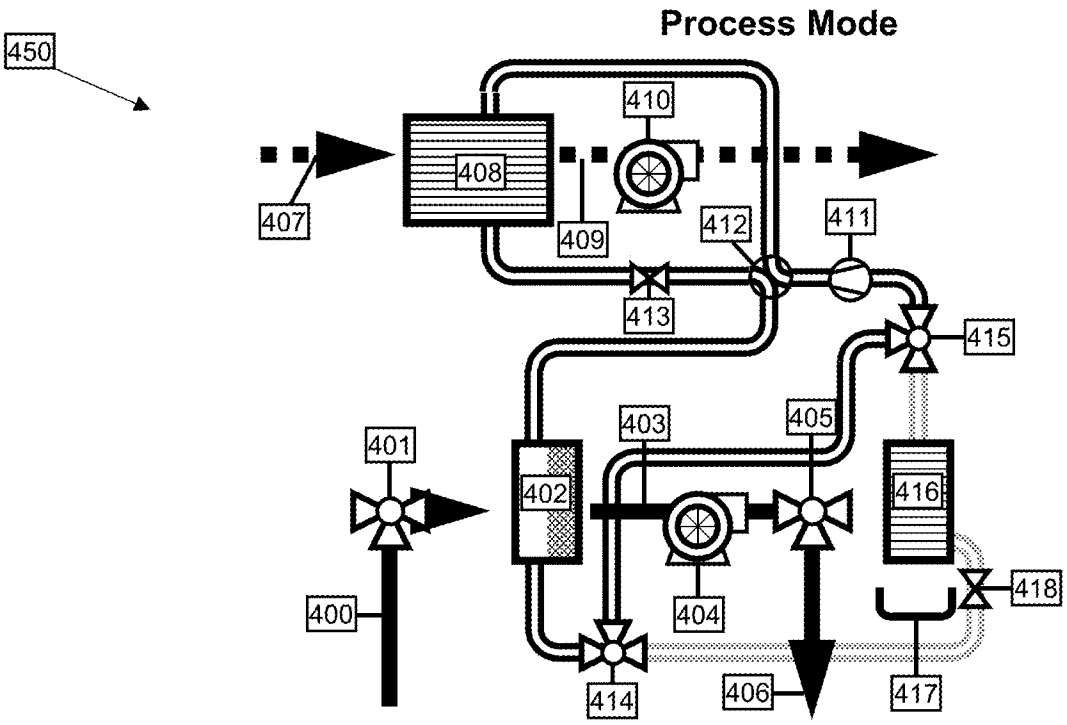
FIGS. 4A-B depicts a cooling and dehumidification system using a solid desiccant coated heat exchanger in a process mode (FIG. 4A) and a regeneration mode (FIG. 4B)
Figure 4B:
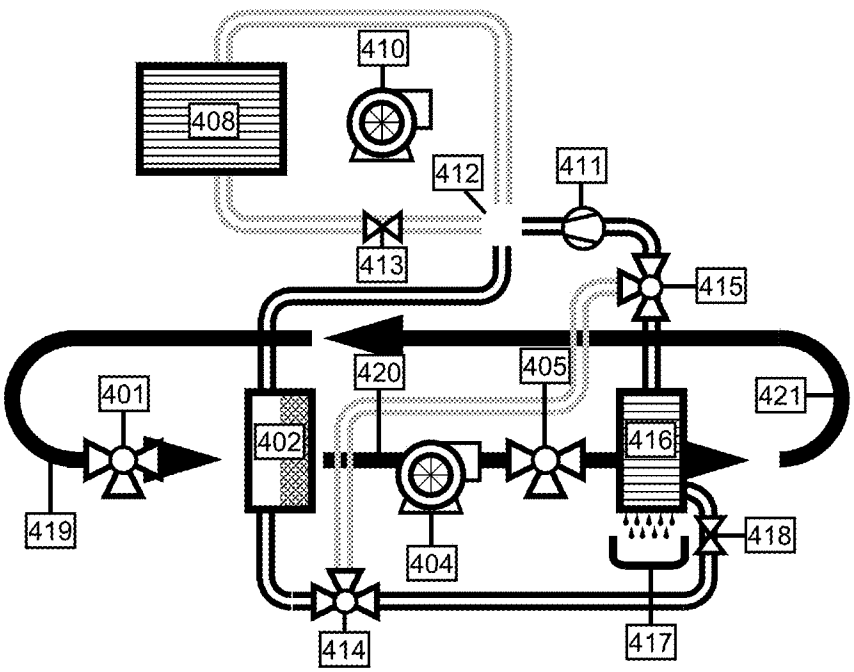

FIGS. 4A-B depicts a cooling and dehumidification system 450 using a solid desiccant coated heat exchanger in a process mode (FIG. 4A) and a regeneration mode (FIG. 4B). The system 450 alternates between two primary modes of operation.

In a process mode depicted in FIG. 4A, return air (400) is drawn into the device by a fan (404). 3-way air duct (401) directs the air through a desiccant coated heat exchanger (402) where it is dried and cooled simultaneously. 3-way air duct (405) directs the cool and dry air back to the conditioned space (406). Refrigerant is compressed by compressor (411), 4-way valve (412) directs high pressure refrigerant to the condenser (408) where it rejects heat to the ambient air as it condenses. Throttling device (413) returns the refrigerant to low pressure. Refrigerant then flows through 4-way valve (412) to desiccant coated heat exchanger (402) which acts as an evaporator in this mode of operation. The refrigerant evaporates in (402), absorbing both sensible heat and latent heat from the heat of adsorption. Bypass valves (414) and (415) return the refrigerant to the compressor (411). In process mode, no refrigerant flows through condensate coil (416).

In a regeneration mode depicted in FIG. 4B, air flows in a closed loop by fan (404) to regenerate the desiccant on (402). Air (419) flows through 3-way air duct (401) to the desiccant coated heat exchanger (402) where it is heated and humidified simultaneously. 3-way air duct (405) directs air to condensate coil (416) where it is cooled below its dew point. Condensate is collected by a reservoir (417), e.g., drip pan, below the coil (416) and removed from the indoor space by a gravity drain or pump. After moisture is removed by condensation, the dry air (421) returns to (419) and repeats the cycle. Refrigerant is compressed by compressor (411), 4-way valve (412) directs high pressure refrigerant to desiccant coated heat exchanger (402) which acts as a condenser in this mode of operation. The refrigerant condenses in (402), releasing heat to both heat the air and desorb moisture from the desiccant. Bypass valve (414) is open in this mode, directing refrigerant to condensate coil (416). The heat from condensation causes refrigerant in (416) to evaporate. The refrigerant then passes through open bypass valve (415) and returns to the compressor.

In some embodiments, the cooling and dehumidification system can include two units in parallel, such that while one is running in process mode, the other is running in regeneration mode. In this configuration, for the indoor unit, all the exchangers, fans, valves, etc., such as the configuration of 5A, would be disposed in a side-by-side arrangement. The outdoor unit, e.g., (408) and (410), in one example, may be implemented as shown in FIGS. 4A-B. Such an arrangement enables continuous cooling rather than intermittent cooling while the system regenerates. In some embodiments, water from a municipal source, rainwater collection, or storage tank is used to cool the condenser (408) by spraying or dripping water over the coils.

Figure 5B:
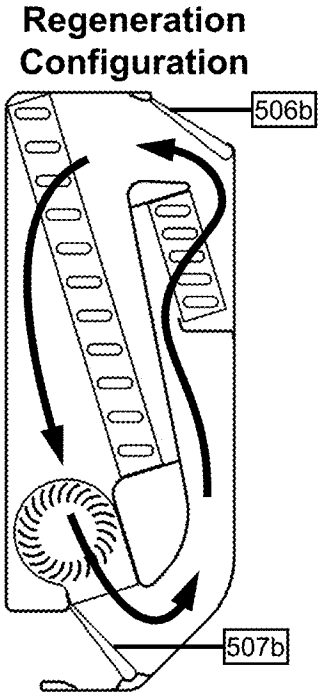
FIGS. 5A-B depict side cutaway views of an embodiment of the indoor unit of a cooling and dehumidification system using a desiccant coated heat exchangers of FIGS. 4A-B in a process mode (FIG. 5A) and regeneration mode (FIG. 5B)
Figure 5A:
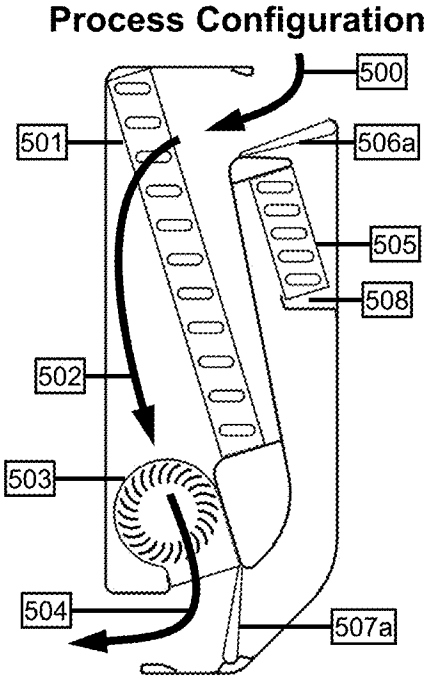

FIGS. 5A-B depict a side cutaway views of an embodiment of the indoor unit of a cooling and dehumidification system using a desiccant coated heat exchangers of FIGS. 4A-B in a process mode (FIG. 5A) and regeneration mode (FIG. 5B).

In this example, the indoor cooling unit can include a desiccant coated heat exchanger and separate water condensing coil arranged to cycle between loading and cooling mode and unloading and water condensing mode, as described below.

In a process mode of FIG. 5A, air is drawn in from the top of the unit (500) through open valve (506*a*) and through coated heat exchanger (501) which acts as an evaporator in process mode. Cool and dry air (502) flows through fan (503) and directed back to the room (504) by open valve (507*a*). In a regeneration mode of FIG. 5B, air (511) is drawn through coated heat exchanger (501) which acts as a condenser in regeneration mode. Hot and moist air (509) flow through fan (503) and is directed by closed air valve (507*b*) to the recirculation path (510) where it flows through condensing coil (505). The air is cooled below the dew point, causing water to condense on the coil (505) where it is collected by the reservoir (508), e.g., drip tray, and removed from the indoor space by a gravity drain or pump.

Figure 6C:
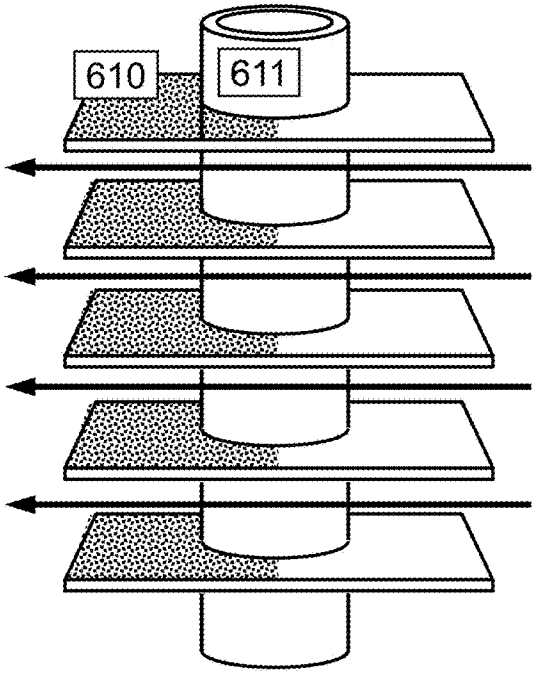
FIG. 6C depicts a side view of the partially desiccant coated heat exchanger of FIGS. 6A-B.
Figure 6B:
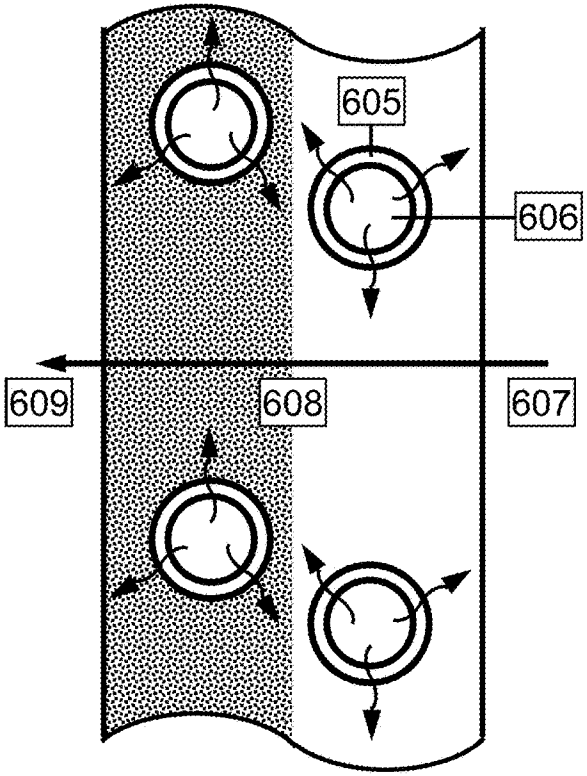
FIG. 6A-B depicts a top cross-sectional view of an embodiment of a partially desiccant coated heat exchanger from FIGS. 5A-B.
Figure 6A:
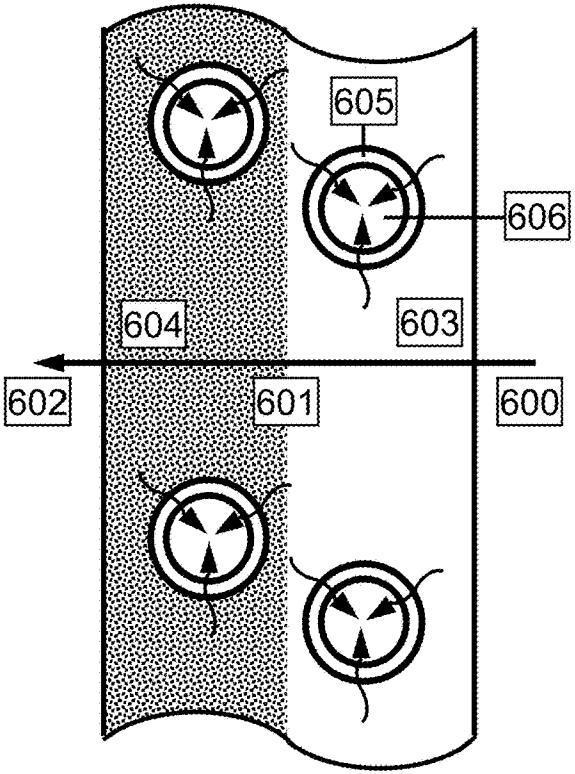
Figure 6D:
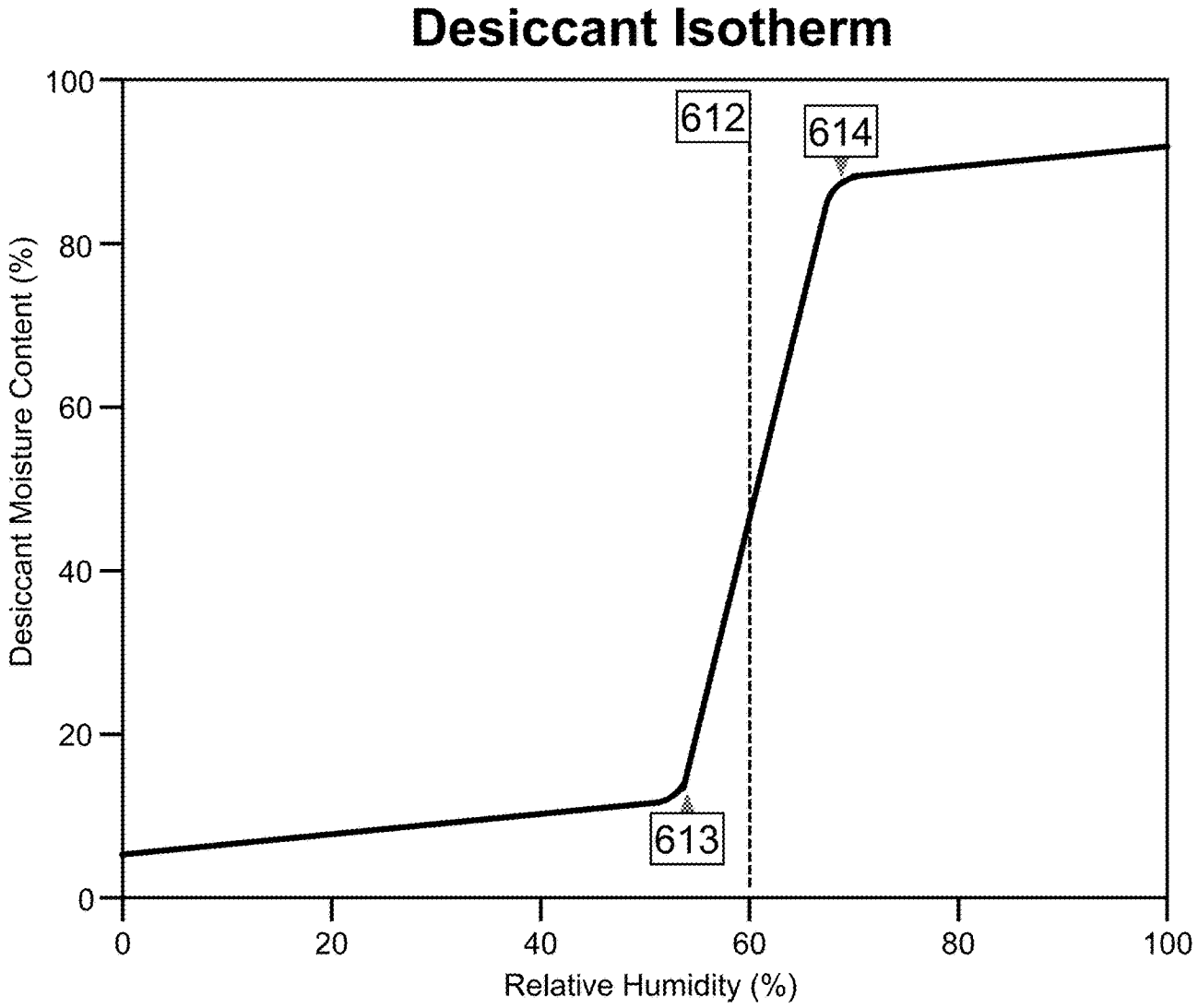
FIG. 6D shows a representative isotherm of the desiccant coating.
Figure 6E:
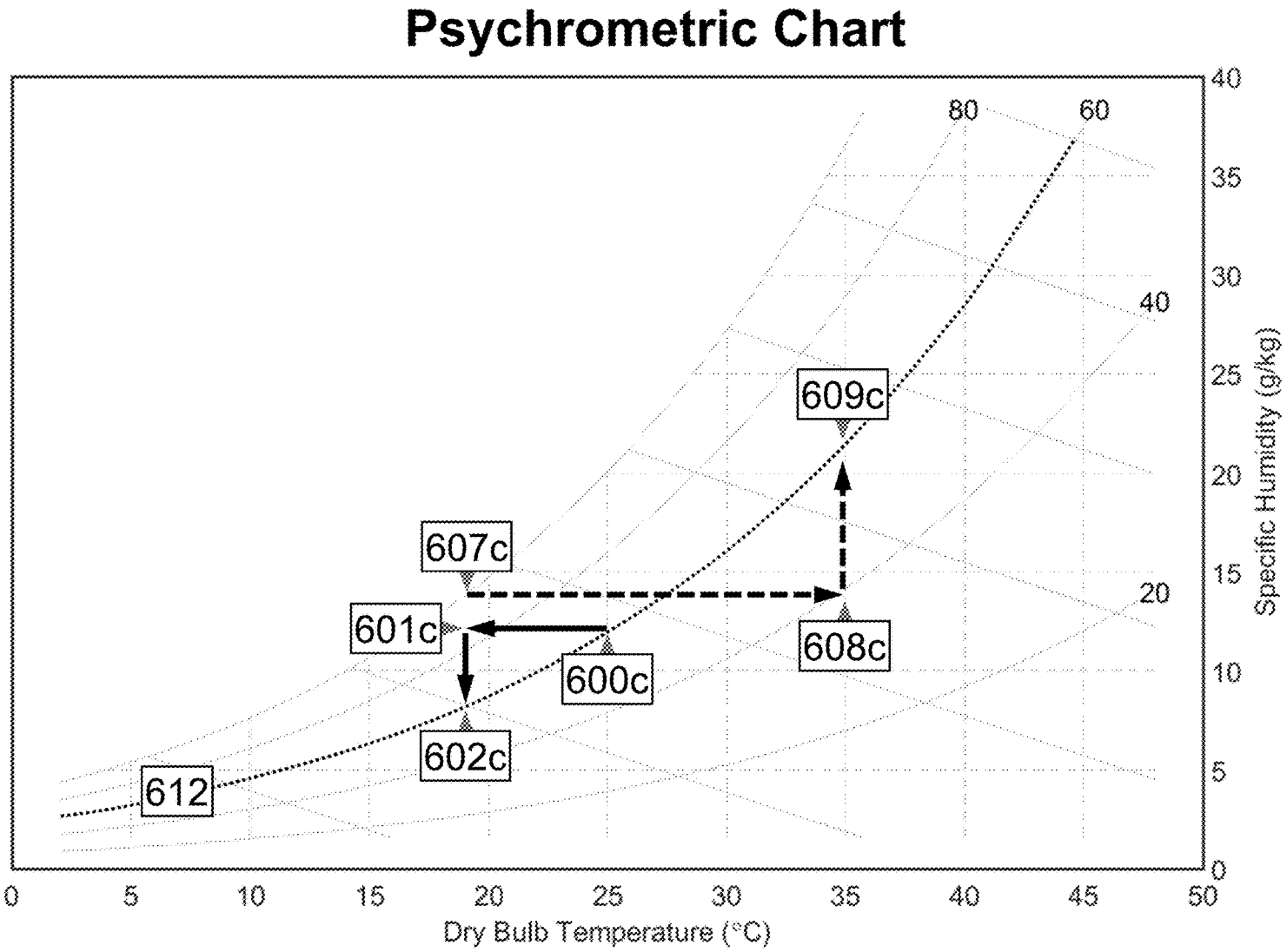
FIG. 6E depicts a psychrometric chart depicting specific humidity (y-axis) vs. dry bulb temperature (x-axis) of the air at various points in the system of FIGS. 6A-B.

FIG. 6A-B shows an embodiment of a partially desiccant coated heat exchanger (501) from FIGS. 5A-B. In this example, the heat exchanger, partially coated with a desiccant material, is configured such that heat and moisture exchange occur sequentially as air passes though the heat exchanger. This allows the heat of adsorption and desorption to be transferred to and from a thermal fluid, as is described below. The heat exchanger consists of a tube or set of tubes (611) which carries refrigerant or thermal fluid and is in thermal contact with a plurality of fins (610). FIG. 6C depicts a side view of the heat exchanger of FIGS. 6A-B. FIG. 6D shows the isotherm of the desiccant coating and the cycle points on the psychrometric chart from the exchanger shown in FIGS. 6A-C. FIG. 6E is a psychrometric chart depicting specific humidity (y-axis) vs. dry bulb temperature (x-axis) of various points in the system of FIGS. 6A-B. The fins are coated on one side (604), for example with a MOF or other desiccant e.g., silica gel, zeolite, or temperature-responsive hygroscopic polymer, and uncoated on the other (603). As depicted, the portion 604 is coated and the portion 603 is uncoated. In some examples, the coated portion 604 can constitute any value between and including approximately 10%-90% of the coating.

In the process cycle of FIG. 6A, air flows across the uncoated section of fins from (600) (depicted as 600*c* in FIG. 6E) to (601) (depicted as 601*c* in FIG. 6E) and is sensibly cooled by transferring heat to the refrigerant (606). The air continues to flow over the coated section of fins from (601) to (602) (depicted as 602*c* in FIG. 6E). Both the sensible heat of cooling and the heat of adsorption are transferred to the refrigerant.

In the regeneration cycle of FIG. 6B, air flows across the uncoated section of fins from (607) (depicted as 607*c* in FIG. 6E) to (608) (depicted as 608*c* in FIG. 6E) and is sensibly heated by heat from the refrigerant (606). The air continues to flow over the coated section of fins from (608) to (609) (depicted as 609*c* in FIG. 6E). The air continues to be sensibly heated by the refrigerant. The refrigerant also supplies the heat of desorption to dry the desiccant.

The extent of the desiccant coating may vary depending on the application and may comprise the full extent (fully coated). The thickness of coating may also vary along the direction of flow. The form of heat exchanger may be a conventional radiator as shown, or a microchannel radiator in which the refrigerant carrying tube is elongated and flattened to span the full width of the exchanger.

FIG. 6D shows the isotherm of the desiccant coating and the cycle points on the psychrometric chart from the exchanger shown in FIGS. 6A-C. The isotherm plots the relative humidity (x-axis) against the moisture content of the desiccant (y-axis). MOFs often have an S-shaped (Type 5) isotherm as shown in which a large step in moisture content (613) to (614) occurs at a specific relative humidity (612). While FIG. 6D depicts a specific isotherm example, other parameters can be implemented (such as other desiccant materials) to yield the overall isotherm shape depicted in FIG. 6D, with other examples having shifts along the y-axis and/or x-axis while still maintain overall plot shape.

During the process cycle, air is cooled from (600) to (601) when it passes over the uncoated portion of the exchanger. It is then dehumidified (601) to (602) as moisture adsorbs onto the desiccant when it passes over the coated portion of the exchanger. In the dehumidification process, the heat of adsorption is transferred to the refrigerant. If the heat of adsorption is greater than the heat removed by the refrigerant, some heat will transfer to the air and (602) will shift to the right of (601) in the chart. If the heat of adsorption is less than the heat removed by the refrigerant, sensible heat will be removed from the air to the refrigerant, and (602) will shift to the left of (601) on the chart. If the heat of adsorption is equal to the heat removed by the refrigerant, isothermal adsorption will occur and the line between (601) and (602) will be vertical as shown.

During the regeneration cycle, air is heated from (607) to (608) when it passes over the uncoated portion of the exchanger. It is then humidified (608) to (609) as moisture desorbs from the desiccant to the airstream. The heat to desorb the desiccant is supplied by the refrigerant. If the heat of desorption is greater than the heat supplied by the refrigerant, (609) will shift to the left of (608) on the chart. If the heat of desorption is less than the heat supplies by the refrigerant, (609) will shift to the right of (608) on the chart. If the heat of desorption is equal to the heat supplied by the refrigerant, isothermal desorption will occur and the line between (608) and (609) will be vertical as shown.

While FIGS. 6A-E depict a selection of isotherm step at 60% relative humidity, a lower or higher step isotherm (e.g., described with respect to FIG. 6D) could be used implemented according to the particular system parameters, such as type of desiccant material.

The system advantageously conducts cooling first then adsorbing and in heating first then desorbing.

Figure 7:
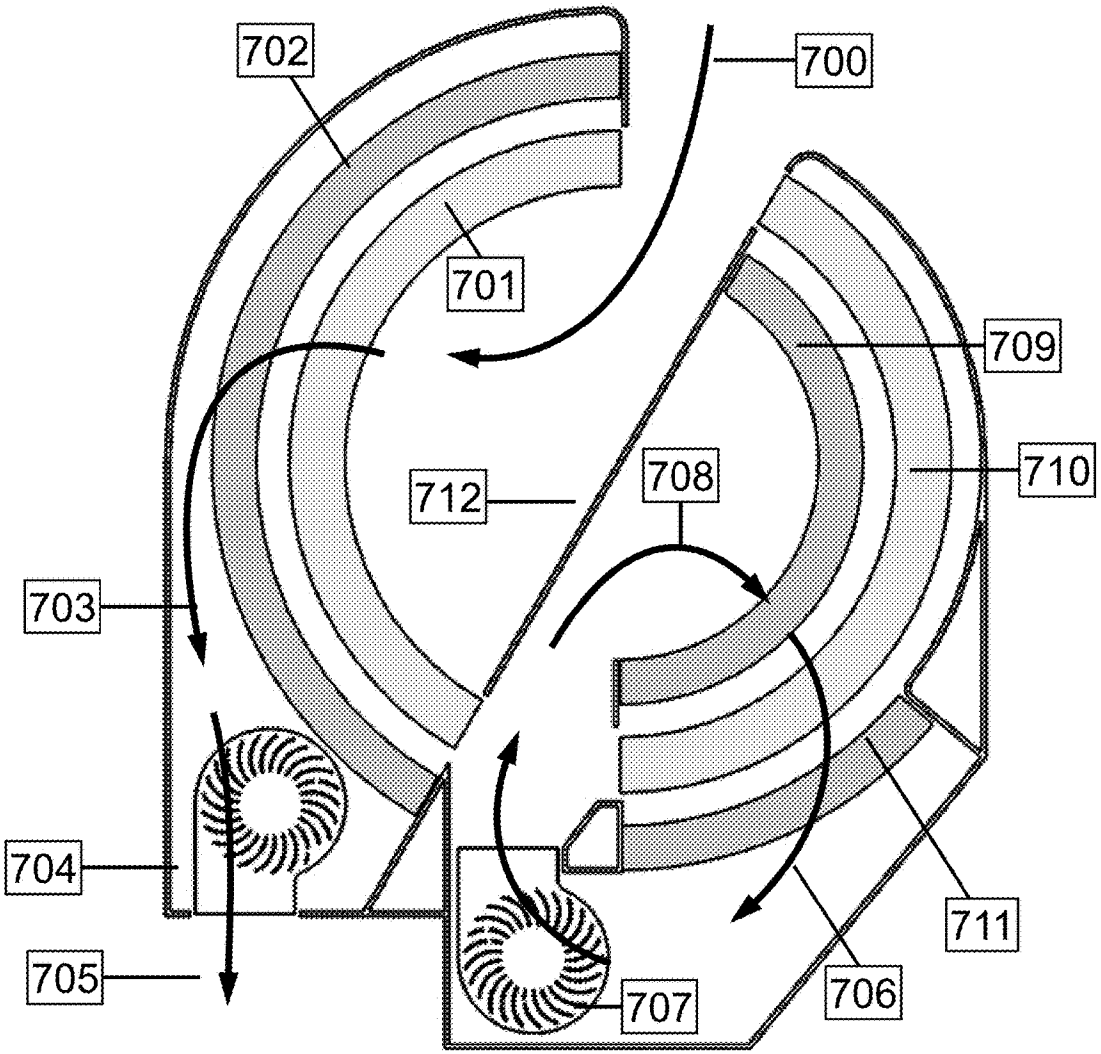
FIG. 7 depicts a side cutaway view of an embodiment of the indoor unit of a rotary desiccant cooling and dehumidification system as depicted in FIGS. 3A-B.

FIG. 7 depicts a side cutaway view of an embodiment of the indoor unit of a rotary desiccant cooling and dehumidification system as depicted in FIGS. 3A-B. In this embodiment, the rotary desiccant device (e.g., a desiccant wheel described above) is replaced with an interrupted rotary drum (701) and (710), also referred to as an interrupted desiccant drum. In the process section, room return air (700) enters the top of the unit and is drawn through the desiccant drum (701) and cooling coil (702). The room return air (700) can be air (e.g., exhaust air) from an air conditioning system. This example allows for the removal of moisture from the air. The cool and dry air (703) is blown back into the room by fan (704). In the regeneration section air (708) flows through a heating coil (709) then through the desiccant drum (710) and finally though condensate coil (711) where it is cooled below its dew point. Condensate falls into a drip pan and is removed by a pump or gravity drain. Fan (707) returns the air to the center section and the cycle repeats. When the process section of desiccant has finished loading, the drum rotates 180 degrees, switching the positions of (701) and (710) to regenerate the desiccant. Divider plate (712) separates the process and regeneration airstreams. In another example, the number of segments may be greater than 2, with only one section residing in the regeneration section at once and multiple sections in the process section. In another example, the drum may be continuous and room air may be drawn in from the end of the unit on one side while regeneration air circuit circulates through the other end. In this embodiment the drum would rotate continuously rather than with intermittently.

While FIG. 7 depicts an interrupted rotary drum, in another example the rotary desiccant device includes a porous cylinder or drum with a static dividing wall inscribed within. In the process section air may be drawn from one end of the drum by a fan and flow radially outward to a static plenum on one side. In the regeneration section air may be drawn from the opposite end of the drum by a fan and flow radially outward to a static plenum on the opposing side. In another embodiment the airflow is reversed on one side such that one side flows inward radially and the other side flows outward radially. As the drum rotates, the desiccant is alternatively exposed to the process airstream and the regeneration airstream, transferring moisture between the two as described previously."

Figure 8A:
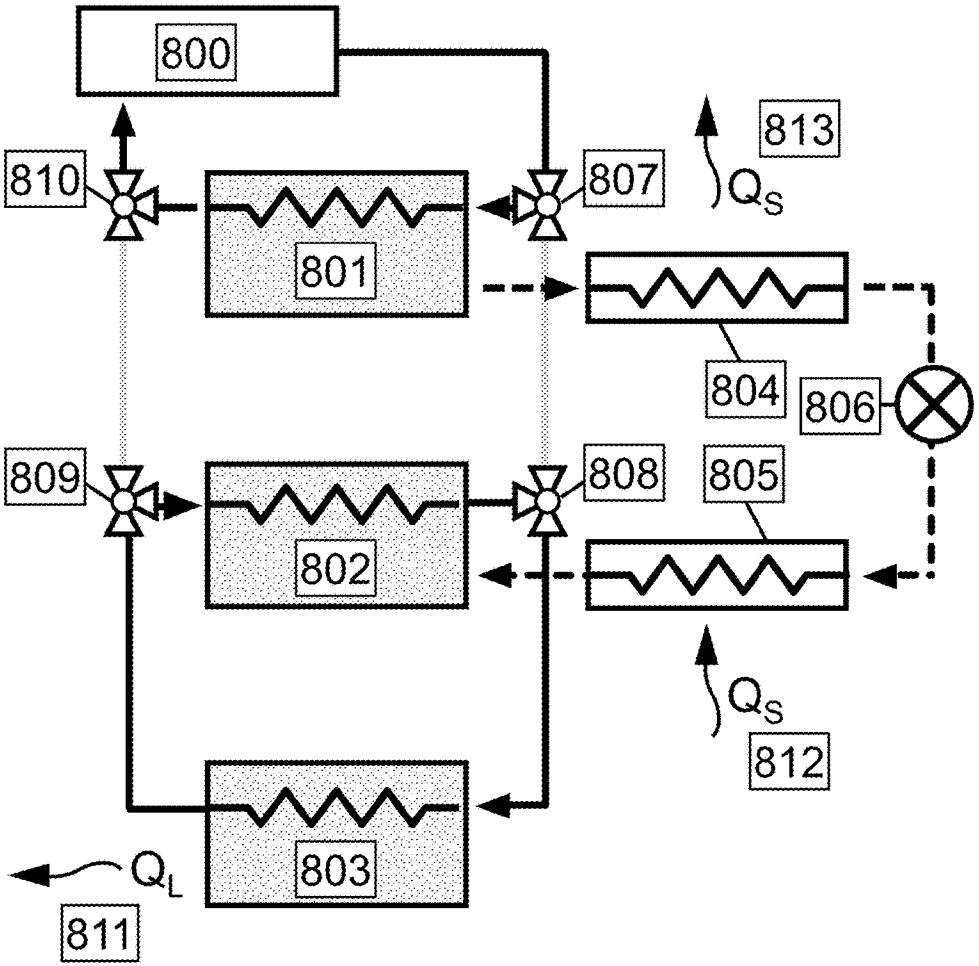
FIGS. 8A-B depict a 3-bed heat driven cooling and dehumidification system which operates in two cycles.
Figure 8B:
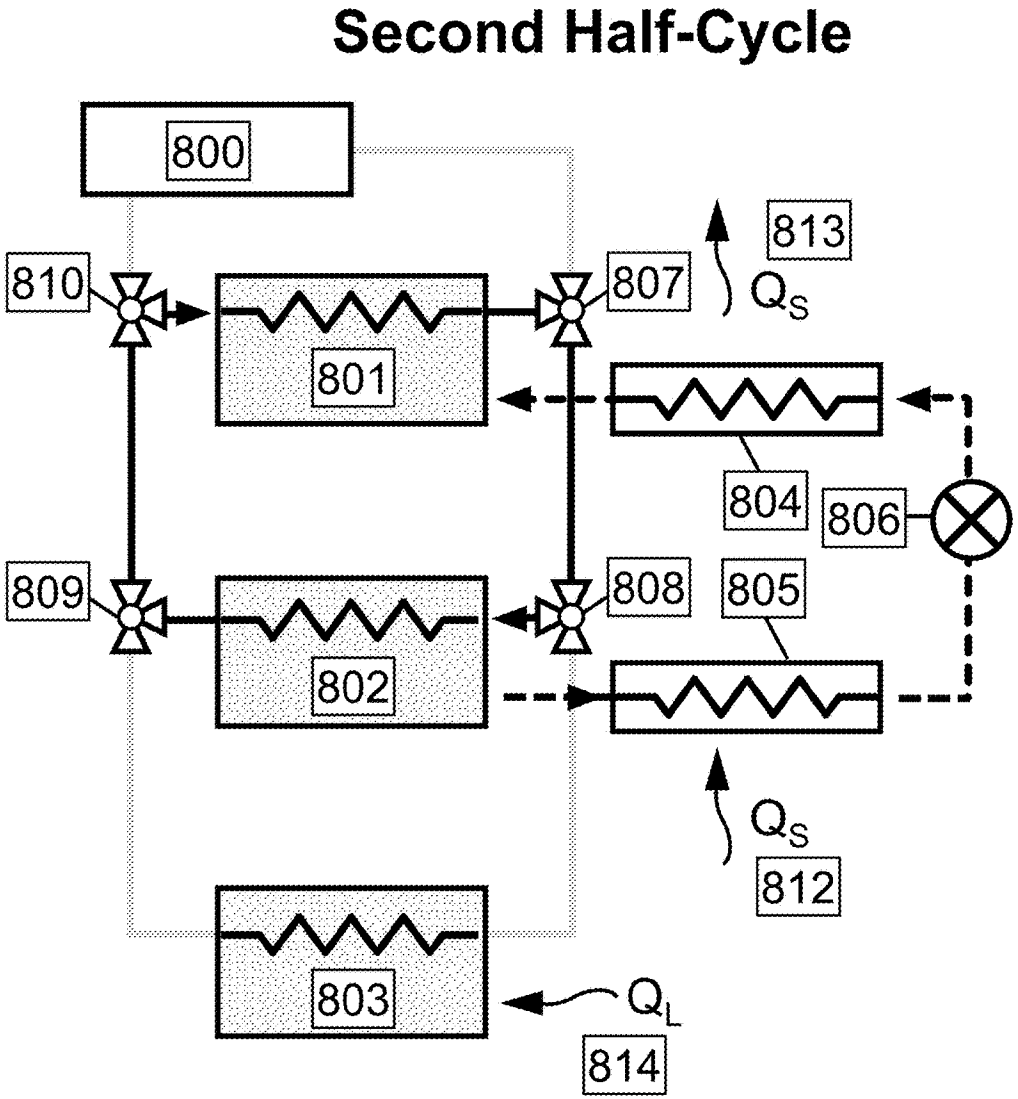
Figure 9A:
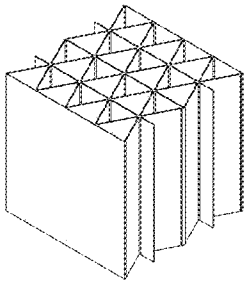
FIGS. 9A-E depict various examples of geometries of the rotary desiccant assembly.
Figure 9B:
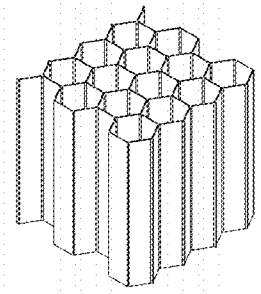
Figure 9C:
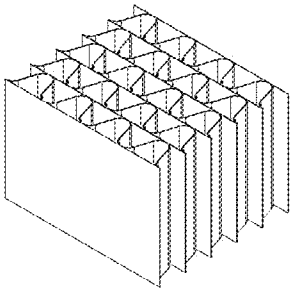
Figure 9D:
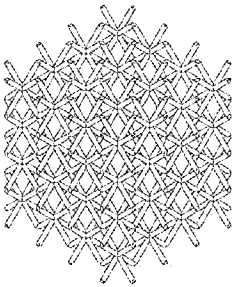
Figure 9E:
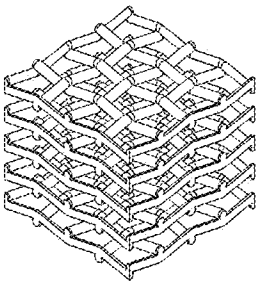

FIGS. 8A-B depicts a 3-bed heat driven cooling and dehumidification system which operates in two cycles. In this example, the system is a cascade cycle adsorption cooling and dehumidification system having at least two closed loop adsorption loops arranged so that heat from a first loop drives the second loop. This system can be followed by an open loop drying cycle to remove moisture from room air as shown below. The system consists of a hot water loop, three solid desiccant beds with embedded heat exchangers, an evaporator (805) and condenser (804), and a metering valve (806). The refrigerant in this system is water and is shown in dashed lines in FIG. 8.

In the first half-cycle of FIG. 8A, hot water from source (800) flows through 3-way valve (807) and heats bed 1 (801) desorbing the bed. Water vapor at high vapor pressure from (801) flows through condenser (804) where it condenses and gives off sensible heat to the ambient environment (813). The water then flows through metering valve (806) to evaporator (805) where it evaporates at low pressure, removing sensible heat from the conditioned space (812). The water vapor is then adsorbed in bed 2 (802) water is circulated from (802) to (803), removing the heat of adsorption from bed 2 and heating bed 3 (803) causing it to desorb. This releases water vapor to the ambient environment (811) as (803) is regenerated.

In the second half-cycle of FIG. 8B, the refrigerant circuit reverses. The hot water source (800) is disconnected and bed 1 (801) adsorbs water from condenser (804). The heat of adsorption is transferred to bed (802) by the hot water loop, now with valves (807), (808), (809), and (810) connecting beds 1 and 2, causing bed 2 (802) to desorb. Latent heat (814) is transferred to bed 3 (803) which has been regenerated in the first half-cycle.

In some embodiments with a rotary desiccant device, a non-contacting thermometer is used to measure the temperature of the desiccant to modulate rotational speed, fan speed, or other operational parameters.

FIGS. 9A-E depict various examples of materials and geometries of the desiccant wheel substrate. As shown in FIG. 8A-C, the desiccant wheel substrate can consist of a pattern of parallel flow channels of various profiles, such as a triangular (FIG. 8A), hexagon e.g., honeycomb (FIG. 8B), and sinusoidal e.g. corrugated (FIG. 8C). As shown in FIG. 8D, the desiccant wheel substrate can be a porous 3D printed lattice structure. As shown in FIG. 8E, the desiccant wheel substrate can be a porous structure formed by a plurality of stacked woven wire screens in aligned or unaligned layers.

Figure 10B:
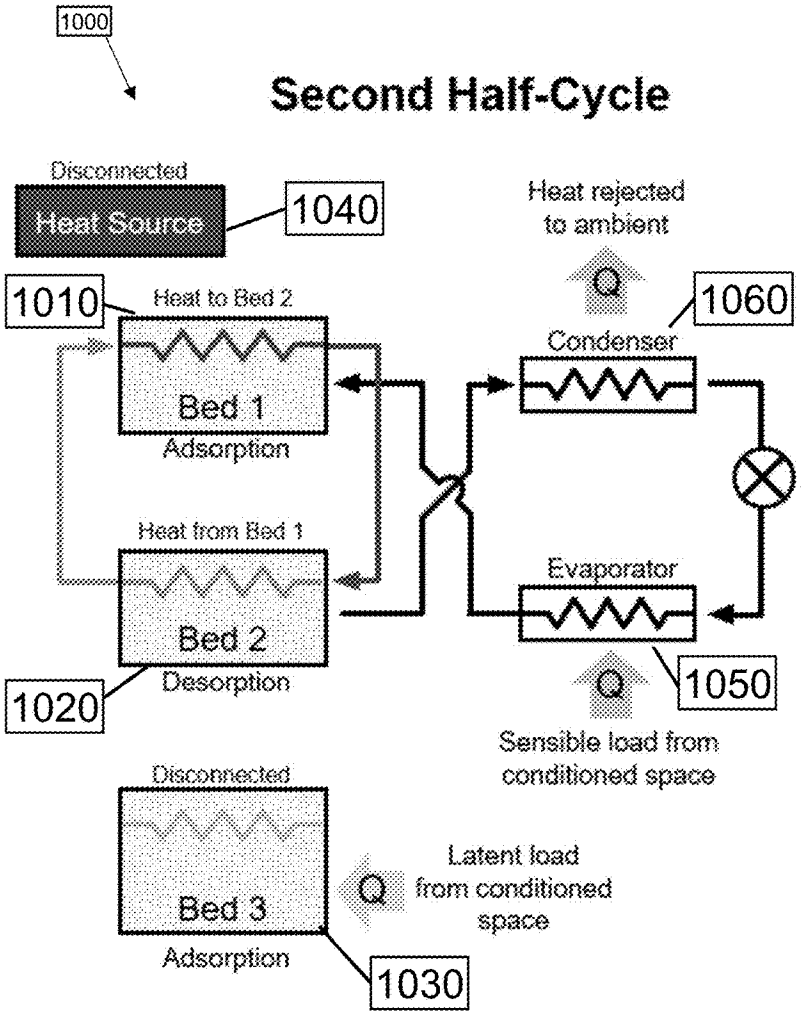
FIGS. 10A-B depict a closed loop adsorption-based air conditioner system 1000 with an open-loop dehumidification cycle.
Figure 10A:
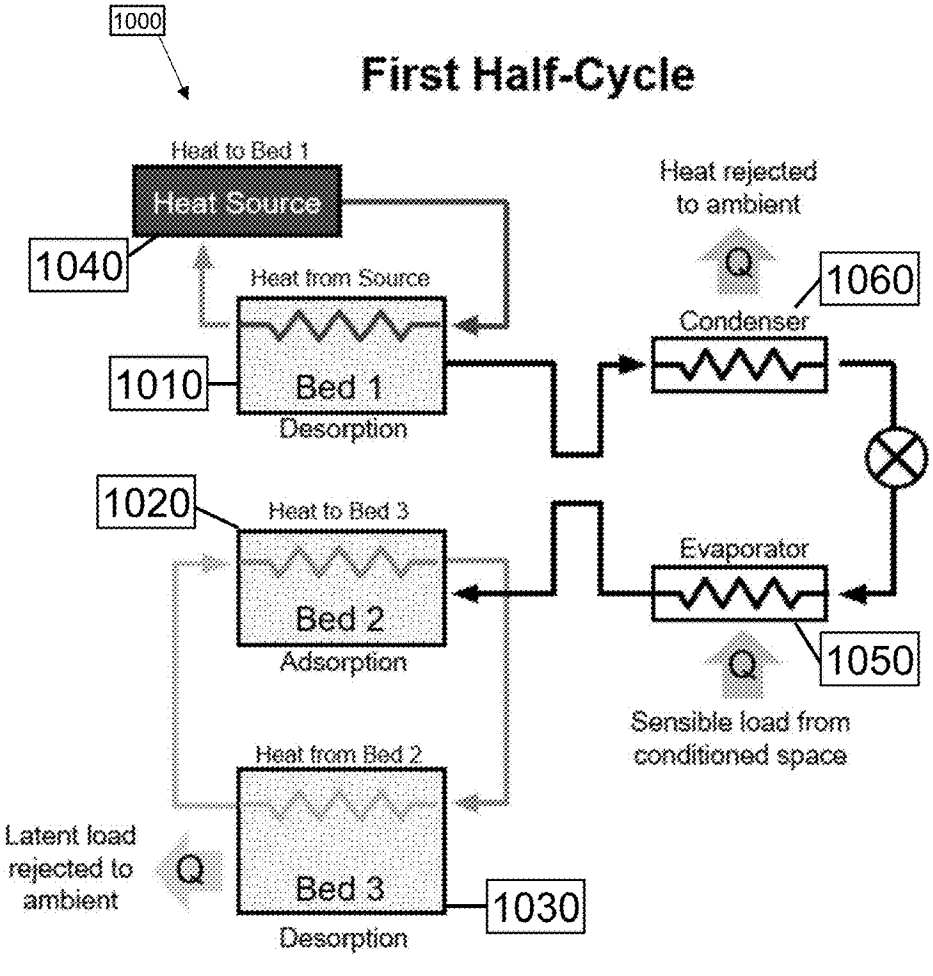

FIGS. 10A-B depict a closed loop adsorption-based air conditioner system 1000 with an open-loop dehumidification cycle. The system 1000 comprises of two adsorbents to drive a cascaded adsorption cooling cycle. The system also includes an evaporator (1050) and a condenser (1060). Referring to FIGS. 10A-B, the system 1000 can achieve a high coefficient of performance (COP) by tuning the adsorbents such that Bed 1 (1010) adsorbent has high uptake at elevated temperatures from which Bed 2 (1020) adsorbent can be fully regenerated. In this example, zeolite (type 1 isotherm) is used for Bed 1 (1010) and a MOF (e.g., MIL-100) for Bed 2 (1020) (type 5 isotherm) and a hydrogel (e.g., poly(N-isopropylacrylamide)) for Bed 3 (1030). In the first half-cycle of FIG. 10A, the initially saturated Bed 1 (1010) is heated by an external heat source (1040) to release water. Simultaneous adsorption of water in Bed 2 (1020)

drives evaporation of water at low pressure, affecting cooling in the evaporator (1050). This facilitates cooling of a dehumidified air stream.

In one example, the system 1000 can use waste heat, such as heat produced by a gas-fired water heater or solar thermal collectors. The dehumidification is enabled by the hydrogel-based system described earlier and is regenerated with the heat of adsorption from Bed 2 (1020). In the second half-cycle of FIG. 10B, the cooling is driven by adsorption in Bed 1 (1010) and the released heat of adsorption is utilized for the desorption of Bed 2 (1020). The specific combination of adsorbents outlined above ensures that highest temperature heat is utilized in Bed 1 (1010) which provides waste heat for desorption of Bed 2 (1020) which in turn provides waste heat for the desiccant dehumidifier Bed 3 (1030).

Advantageously, hydrogels such as poly(N-isopropylacrylamide) can be used for dehumidification cycles, as moderate heating has shown to fully dehydrate the hydrogels and release the capture water in the liquid state (unlike conventional adsorbents which release water in vapor state).

In this regard, hydrogels address latent cooling loads, because they enable a more direct collection of water vapor from humid air than incumbent systems. Since hydrogels release liquid water directly upon heating to the lower critical solution temperature (LCST), condensate may be collected directly from the bed, eliminating the need for a condensing coil to capture the water removed from the room air. Since heat is supplied directly to the hydrogel rather than to an intermediate airstream, heat transfer losses are minimized. These features enable reduced system size, cost, and complexity while improving efficiency of the dehumidification cycle. Like hydrogels, metal-organic frameworks (MOFs), such as MIL-100, are sponge-like, highly porous materials that have very high surface area and can be regenerated with low-grade heat.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. Accordingly, this description is meant to be taken only by way of example, and not to otherwise limit the scope of this invention.

What is claimed is:

1. A heat exchanger assembly, comprising:

at least one tube configured to carry refrigerant or thermal fluid;

a plurality of fins in thermal contact with the at least one tube, wherein each of the plurality of fins comprises a coated portion and an uncoated portion on a single surface of each of the plurality of fins; and a fan positioned relative to the heat exchanger assembly, wherein the fan and assembly are configured to operate a regeneration cycle in which:

a) the fan and assembly direct air to flows across the uncoated portion of each of the plurality of fins wherein the air is sensibly cooled by transferring heat to the refrigerant or thermal fluid; and b) after a), the fan and assembly direct air to flows across the coated portion of each of the plurality of fins.

2. The assembly of claim 1, wherein the coated portion comprises approximately 10%-90% of each respective fin.

3. The assembly of claim 1, wherein the coated portion comprises at least one of:

a metal organic framework (MOF); silica gel zeolite; or temperature-responsive hygroscopic polymer.

4. The assembly of claim 1, wherein the coated portion comprises a metal organic framework (MOF).

5. A heat exchanger assembly, comprising:

at least one tube configured to carry refrigerant or thermal fluid;

a plurality of fins in thermal contact with the at least one tube, wherein each of the plurality of fins comprises a coated portion and an uncoated portion on a single surface of each of the plurality of fins; and a fan positioned relative to the heat exchanger assembly, wherein the fan and assembly are configured to operate a regeneration cycle in which:

a) the fan and assembly direct air to flows across the uncoated portion of each of the plurality of fins wherein the air is sensibly heated by transferring heat from the refrigerant or thermal fluid; and b) after a), the fan and assembly direct air to flows across the coated portion of each of the plurality of fins and wherein the air continues to be sensibly heated by the refrigerant or thermal fluid.

6. The assembly of claim 5, wherein the coated portion comprises approximately 10%-90% of each respective fin.

7. The assembly of claim 5, wherein the coated portion comprises at least one of:

a metal organic framework (MOF); silica gel zeolite; or temperature-responsive hygroscopic polymer.

8. The assembly of claim 5, wherein the coated portion comprises a metal organic framework (MOF).

* * * * *